US009060232B2

(12) United States Patent
Hain et al.

(10) Patent No.: US 9,060,232 B2
(45) Date of Patent: Jun. 16, 2015

(54) HEARING AID DEVICE WITH A DIRECTIONAL MICROPHONE SYSTEM AND METHOD FOR OPERATING A HEARING AID DEVICE HAVING A DIRECTIONAL MICROPHONE SYSTEM

(75) Inventors: Jens Hain, Kleinsendelbach (DE); Dirk Junius, Möhrendorf (DE); Matthias Müller-Wehlau, Erlangen (DE); Sebastian Pape, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 454 days.

(21) Appl. No.: 13/437,046

(22) Filed: Apr. 2, 2012

(65) Prior Publication Data

US 2012/0250916 A1 Oct. 4, 2012

(30) Foreign Application Priority Data

Mar. 31, 2011 (DE) ..... 10 2011 006 471

(51) Int. Cl.
*H04R 25/00* (2006.01)

(52) U.S. Cl.
CPC ..... *H04R 25/405* (2013.01); *H04R 25/407* (2013.01); *H04R 2225/41* (2013.01); *H04R 2225/43* (2013.01)

(58) Field of Classification Search
CPC ..... H04R 25/40; H04R 25/43; H04R 25/405; H04R 25/407; H04R 25/505; H04R 2410/07; H04R 2225/41; H04R 2225/43; H04R 3/005; H04R 29/006
USPC ..... 381/312–331
See application file for complete search history.

(56) References Cited

U.S. PATENT DOCUMENTS

| | | | |
|---|---|---|---|
| 4,425,481 | A | 1/1984 | Mansgold et al. |
| 5,757,933 | A | 5/1998 | Preves et al. |
| 7,340,068 | B2 | 3/2008 | Petersen et al. |
| 2002/0041696 | A1 | 4/2002 | Jensen |

FOREIGN PATENT DOCUMENTS

| | | | |
|---|---|---|---|
| EP | 0064042 | A1 | 11/1982 |

*Primary Examiner* — Matthew Eason
(74) *Attorney, Agent, or Firm* — Laurence A. Greenberg; Werner H. Stemer; Ralph E. Locher

(57) ABSTRACT

A hearing aid device has a directional microphone system with a first microphone outputting a first microphone signal and a second microphone outputting a second microphone signal. A delay unit generates a directivity by delaying the second microphone signal or a fourth microphone signal derived therefrom by an internal time delay and associating it with the first microphone signal or a third microphone signal derived therefrom for generating a directional microphone signal. A cross-correlation analysis unit receives the first or the third microphone signal and the second or the fourth microphone signal and determines a value of a cross correlation of the two microphone signals. A control unit adjusting the time delay depending on the value of the cross correlation of the two microphone signals. A classifier determines audio conditions in which the hearing aid device is currently situated, and the time delay is adjusted depending on the audio conditions.

16 Claims, 3 Drawing Sheets

HEARING AID DEVICE WITH A DIRECTIONAL MICROPHONE SYSTEM AND METHOD FOR OPERATING A HEARING AID DEVICE HAVING A DIRECTIONAL MICROPHONE SYSTEM

CROSS-REFERENCE TO RELATED APPLICATION

This application claims the priority, under 35 U.S.C. §119, of German application DE 10 2011 006 471.0, filed Mar. 31, 2011; the prior application is herewith incorporated by reference in its entirety.

BACKGROUND OF THE INVENTION

Field of the Invention

The invention relates to a hearing aid device with a directional microphone system. The device which has a directional microphone system with at least a first microphone, from which a first microphone signal is emitted, a second microphone, from which a second microphone signal is emitted, and a delay unit (T). For the purpose of generating a directivity, the second microphone signal or a fourth microphone signal derived therefrom is delayed in the delay unit by an internal time delay and is associated with the first microphone signal or a third microphone signal derived therefrom; a cross-correlation analysis unit, at which the first or the third microphone signal and the second or the fourth microphone signal arrive, determines a value of a cross correlation of the two microphone signals; a control unit adjusts the time delay depending on a value of the cross correlation of the two microphone signals.

The invention further relates to a method for operating such a hearing aid device in order to provide directional microphone functionality.

A hearing aid device according to the invention is understood to mean any device which delivers an output signal that can be discerned by a user as an acoustic signal, or which contributes to the delivery of such an output signal, and which features means that serve to or help to compensate for an individual hearing loss suffered by the user. In particular, such devices here comprise hearing devices which can be worn on the body or on the head, in particular on or in the ear, and which can also be wholly or partially implanted. However, such devices also comprise those whose primary purpose is not to compensate for hearing loss, e.g. devices in the field of entertainment electronics (televisions, Hi-Fi systems, MP3 players, etc.) or communication devices (mobile telephones, PDAs, headsets etc), but which nonetheless provide means for compensating for an individual loss of hearing.

In order to provide binaural support for a user, use is normally made of a hearing aid device system comprising two hearing aid devices, in particular hearing devices, which can be worn on or in the ear. In addition to at least one hearing aid device that can be worn on or in the ear, a hearing aid device system can also comprise at least one further device, e.g. an external processor unit that can be worn on the body of the user. The external processor unit can be used for remote control of the hearing aid device or hearing aid device system, for example, but can also perform other functions such as analysis of the acoustic audio environment, for example.

A hearing aid device normally comprises an input converter for picking up an input signal. The input converter is designed as a microphone, for example, which picks up an acoustic signal and converts it into an electrical signal. However, input converters can also be units which feature a coil or an antenna and which pick up an electromagnetic signal and convert it into an electrical signal. Furthermore, a hearing aid device normally comprises a signal processing unit for processing and frequency-dependent amplification of the electrical signal. For the purpose of signal processing in the hearing aid device, provision is made for a preferably digital signal processor (DSP), whose mode of working can be influenced by means of programs or parameters that can be transferred to the hearing aid device. Consequently, the mode of working of the signal processing unit can be adapted to both the individual hearing loss of a hearing aid device wearer and the current audio conditions in which the hearing aid device is being operated. The electrical signal which has been changed thus is then supplied to an output converter. This is normally designed as a headphone, which converts the electrical output signal into an acoustic signal. However, other embodiments are also possible here, e.g. an implant-type output converter that is connected directly to an auditory ossicle and causes the latter to vibrate.

European published patent application EP 0 064 042 A1 and U.S. Pat. No. 4,425,481 describe a hearing aid device comprising a classifier which analyzes the microphone signal entering the hearing aid device and automatically recognizes the audio conditions in which the hearing aid device is currently situated. Depending on the audio conditions that are recognized, the parameters relating to signal processing in the hearing aid are automatically adjusted.

A modern hearing aid device usually comprises a directional microphone system, by means of which in particular the articulation can be improved in various audio conditions, e.g. during a conversation in an environment where interference noise is present. A directional microphone system conventionally comprises at least two microphones, whose outputs are connected together and whose output signals are associated in order to achieve directivity. Depending on the interconnexion of the microphones, in particular on an internal signal delay between the two microphone signals, it is possible to adjust different directional characteristics. The AI-DI (articulation index directivity index) is normally used as a measure for the directivity. In order to achieve the desired directivity for a directional microphone system, an internal base time delay between the microphone signals must be carefully adjusted for each new hearing aid device. This is usually done using so-called KEMAR measurements for a specific wearing position of the respective hearing aid device, wherein a reference signal is presented from a frontal direction. The base time delay is normally adjusted so as to optimize reception of an acoustic signal arriving from the front (relative to the direction of view) and to maximize suppression of an acoustic signal arriving from the opposite direction (from behind).

U.S. Pat. No. 5,757,933 describes a hearing aid device which features a directional microphone system comprising two electrically interconnected microphones, wherein different directional characteristics can be adjusted depending on a signal delay between the generated microphone signals.

Two problems occur in respect of the adjustment of the base time delay: firstly the base time delay depends largely on the effective distance of the two microphones relative to an acoustic source, and secondly the effective base time delay is also frequency-dependent due to the frequency-dependent diffraction and reflection of the sound. The frequency-dependent base time delay is normally determined using KEMAR measurements, but is to a large extent dependent on the reflection properties of the audio environment of the hearing aid device.

The first problem is highly relevant for universal (instant fit) hearing aid devices having fixed tube length or cable length between the respective hearing aid device and an associated otoplastic. As a result of the predetermined tube length or cable length, the positions of the individually worn hearing aid devices vary more than in the case of a conventional adaptation, because in the case of the latter the acoustician can manually adapt the tube length to the individual ear of the respective user, thereby ensuring that the ideal position is achieved. The greater the deviation of an angle a between a connection line of the microphone openings and the horizontal plane, for a hearing aid device worn by a user, from the angle a that was determined on the KEMAR during the development process for the optimal wearing position, the more ineffective the directivity of the directional microphone system, i.e. the AI-DI decreases.

The second problem occurs irrespective of the wearing position concerned. Individual factors such as haircut or shape of the head and pinna influence the frequency-dependent group delay and therefore adversely affect the performance of the directional microphone system.

United States Patent Application Publication No. US 2002/0041696 A1 describes a hearing aid device comprising a directional microphone system as per the preamble of claim 1 and a method for operating such a hearing aid device as per the preamble of claim 10.

U.S. Pat. No. 7,340,068 B2 describes a device and a method for determining wind noise, in which provision is made for generating a first time-dependent correlation signal consisting of values of a cross-correlation function between a first and a second microphone signal, and a second time-dependent correlation signal consisting of values of an autocross-correlation function of either the first or the second microphone signal.

SUMMARY OF THE INVENTION

It is accordingly an object of the invention to provide a hearing aid device and method with direction microphone processing which overcome the above-mentioned disadvantages of the heretofore-known devices and methods of this general type and which provides for a device and a method that achieves superior performance of a directional microphone system for a hearing aid device, irrespective of the individual wearing position of the hearing aid device.

With the foregoing and other objects in view there is provided, in accordance with the invention, a hearing aid device with a directional microphone system, comprising:

a first microphone configured to output a first microphone signal and a second microphone configured to output a second microphone signal;

a delay unit configured for generating a directivity by delaying the second microphone signal or a fourth microphone signal derived therefrom by an internal time delay and associating with the first microphone signal or with a third microphone signal derived therefrom for the purpose of generating a directional microphone signal;

a cross-correlation analysis unit connected to receive the first or the third microphone signals and to receive the second or the fourth microphone signals, and configured for determining a value of a cross correlation of the two microphone signals;

a classifier for determining an audio condition in which the hearing aid device is currently situated; and a control unit for adjusting the time delay in dependence on the value of the cross correlation of the two microphone signals, wherein the time delay is adjusted depending on the audio condition.

There is also provided, in accordance with the invention, a method of operating a hearing aid device provided with a directional microphone system having a first microphone, from which a first microphone signal is output, and a second microphone, from which a second microphone signal is output, the method which comprises:

generating a directivity by delaying the second microphone signal or a fourth microphone signal derived therefrom in a delay unit by an internal time delay and associating with the first microphone signal or a third microphone signal derived therefrom;

determining a value of a cross-correlation of the two microphone signals; and determining audio conditions in which the hearing aid device is currently situated; and adjusting the internal time delay depending on the value of the cross-correlation of the two microphone signals and depending on the current audio conditions.

The fundamental idea of the invention is that of using a cross-correlation analysis to determine the time delay with which an acoustic signal arrives at the microphones, in particular at the microphone opening that is assigned to the respective microphone in the housing of the hearing aid device. The internal time delay for at least one microphone signal that is generated by one of the two microphones is then applied depending on the external delay that was determined by the correlation analysis.

By virtue of the invention, the internal delay can be adapted to the individual external delay that is dependent on the wearing position. Optimized directivity can therefore be adjusted with reference to the individual wearing position. Even if the individual wearing position deviates from the ideal wearing position, a high performance of the relevant directional microphone system, in particular a high AI-DI, is achieved.

The novel hearing aid device according to the invention also comprises a classifier for determining the audio conditions in which the hearing aid device is currently situated, wherein the adjustment of the time delay takes place depending on the audio conditions. Determining the effective distance of the microphones of the directional microphone system concerned is particularly efficient if the location of the acoustic source, from which an acoustic signal emerges and is captured by the microphones, in relation to the microphones is known. This can be assumed in certain audio conditions. In the audio conditions "conversation background quiet", for example, it is assumed that the hearing aid device wearer is facing the conversation partner. This is therefore an ideal moment for determining the effective distance between the microphones. In addition to the audio conditions "conversation background quiet", this however also applies to other audio conditions, e.g. "television".

A cross-correlation function is advantageously used to determine the time delay with which an acoustic signal arrives at the microphones. It is generally used in the signal analysis to describe the correlation of two signals x(t) and y(t) at different time displacements t between the two signals. It shows e.g. maxima in the case of time displacements which correspond to the group delay from the measurement location of the signal x(t) to the measurement location of the signal y(t). Propagation time differences from a signal source to both measurement locations can also be established in this way. In the case of a time delay $\tau$, the cross-correlation function of the microphone signals has a maximum which corresponds to the propagation time of the acoustic signal between the two microphones (specifically: between the two microphone openings in the housing of the hearing aid device). This time delay is designated as effective time delay $\tau_{eff}$. By virtue of the cross-correlation function, it is therefore easily possible to determine the effective external propagation time, between the two microphones, of an acoustic signal that arrives from a frontal direction (as seen by the user) at the hearing aid device which is worn in an individual position.

The internal time delay between the microphone signals is advantageously not adjusted on the basis of a single instance of determining the cross-correlation function of the two microphone signals, and hence on the basis of a single calculation of the effective time delay $\tau_{eff}$. Instead, the cross-correlation function and hence the effective time delay $\tau_{eff}$ are advantageously determined more than once within a specific time period. A resulting effective time delay $\tau_{eff,\ res}$ is preferably determined therefrom by means of a histogram analysis. Stable results can be achieved in this way. For the purpose of histogram analysis, the time displacement $\tau$ is divided into specific time segments and, for each time segment, the frequency with which the effective time delay $\tau_{eff}$ occurs in this time segment is determined. The resulting effective time delay $\tau_{eff,\ res}$ is then derived from that time segment in which the determined effective time delays $\tau_{eff}$ are most frequent.

In the case of a hearing aid device that can be worn behind the ear, comprising a directional microphone system which has a front and a back microphone, the internal (base) time delay of the microphone signal that is generated by the back microphone is advantageously adjusted so as to be identical to the effective time delay $\tau_{eff}$ or resulting effective time delay $\tau_{eff,\ res}$ that was determined in the manner described above. This is the base time delay, by means of which an acoustic signal arriving directly from behind (as seen by the hearing aid device wearer) is largely erased (cardioid radiation pattern). In order to vary the direction of maximal signal suppression, it is nonetheless also possible to set a time delay that differs from the base time delay. Using a directional microphone system comprising two microphones, it is thus possible to set a super-cardioid, hyper-cardioid or even figure-of-eight radiation pattern, for example.

As described in the introduction, the external time delay is frequency-dependent as a result of diffraction and reflection effects. According to a preferred embodiment of the invention, provision is therefore made for determining an internal time delay which is also time-dependent. This can easily be achieved by first supplying the microphone signals that are output from the microphones to a filter bank in each case. This results in the microphone signals being split into frequency bands. The internal time delay is then determined separately for the respective frequency band. The influence of diffraction and reflection effects can be largely suppressed in this way.

In order to prevent systematic errors in the calculation of the effective time delay, and hence in the adjustment of the internal time delay, the calculated effective time delay or resulting effective time delay is first subjected to a validation check before the internal time delay is adapted. In particular, erroneous values relating to the effective time delay can be determined in the case of a reverberant environment or an incorrect spatial orientation of the relevant hearing aid devices. In order to prevent erroneous adjustment of the internal time delay, e.g. threshold values can be specified for the calculated effective time delay, wherein the internal time delay is not adapted if a threshold value is exceeded. In the case of a hearing aid device system comprising two hearing aid devices worn on the head, a further possibility consists in performing a comparison of the effective time delays that are determined in the two hearing aid devices. If these time delays differ excessively, this indicates audio conditions that are not suitable for the adjustment according to the invention.

In a preferred embodiment of the invention, there is no sudden switch from the previously used internal time delay to the newly calculated internal time delay, and instead a more gradual transition between the two time delays takes place (fading). Switching-related artifacts are thereby avoided.

In summary, the invention offers the following advantages:

a. By virtue of using statistical methods (histogram analysis), an individually adapted and hence more effective directivity is achieved.

b. Frequency-dependent diffraction and reflection effects are taken into consideration, and therefore high directivity is achieved over the entire frequency range concerned.

c. By virtue of a hearing aid device that is adjusted according to the invention, the speech understanding in varying audio environments is significantly improved.

Other features which are considered as characteristic for the invention are set forth in the appended claims.

Although the invention is illustrated and described herein as embodied in a hearing aid device comprising a directional microphone system and method for operating a hearing aid device comprising a directional microphone system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
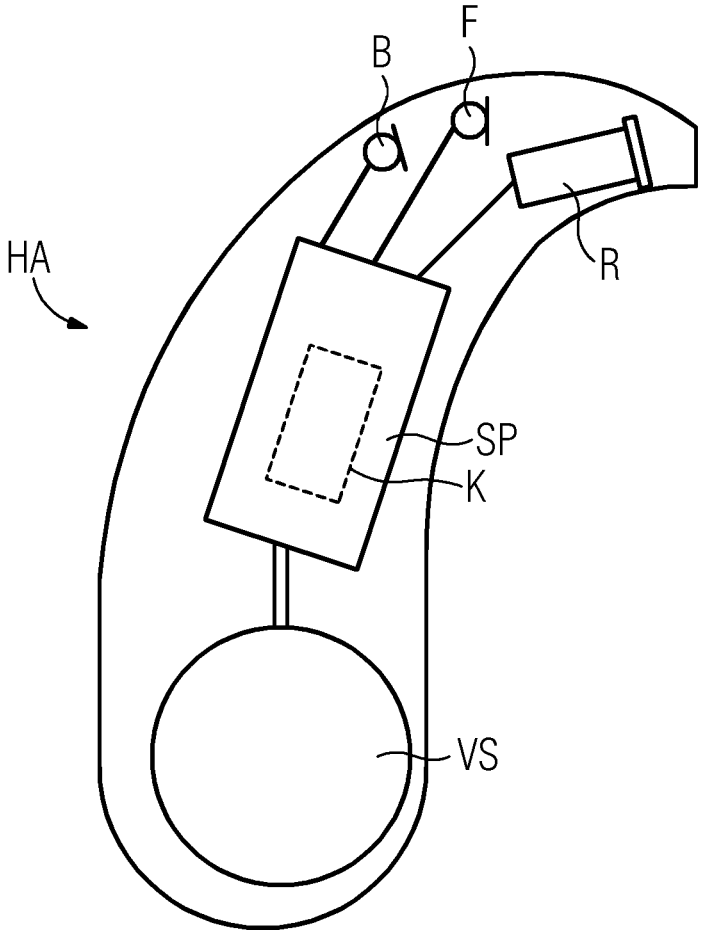
FIG 1 PRIOR ART
FIG. 1 shows a greatly simplified schematic illustration of a hearing aid device that can be worn behind the ear as per the prior art.

Referring now to the figures of the drawing in detail and first, particularly, to FIG. 1 thereof, there is shown a greatly simplified and schematic exemplary illustration of the structure of a hearing aid device, in particular a hearing aid device HA which can be worn behind the ear, as per the prior art. Hearing aid devices generally comprise at least an input converter, an amplifier and an output converter as their essential components. The input converter is normally a sound receiver, e.g. a microphone, and/or an electromagnetic receiver, e.g. an induction coil. The output converter is usually realized as an electroacoustic converter, e.g. a miniature loudspeaker or headphone, or an electromechanical converter, e.g. bone conduction headphone. The amplifier is usually integrated into a signal processing unit. In the exemplary embodiment according to FIG. 1, a front microphone F and a back microphone B for picking up the sound from the environment are incorporated into a hearing aid device housing that is designed for wearing behind the ear. A signal processing unit SP, which is likewise situated in the housing of the hearing aid device HA, processes and amplifies the microphone signals. The output signal of the signal processing unit SP is transferred to a loudspeaker or headphone R, which outputs an acoustic signal. If applicable, the sound is transferred to the tympanic membrane of the user via a sound tube (not shown) which is fastened in the auditory canal by means of an otoplastic. The energy supply of the hearing aid device and in particular that of the signal processing unit SP is effected by means of a voltage source VS, e.g. a battery, which is likewise arranged in the hearing aid device HA.

As a special feature, the signal processing unit of the known hearing aid device according to FIG. 1 comprises a classificator or classifier K, which can establish the audio environment or the audio conditions in which the hearing aid device HA is currently situated on the basis of an analysis of the microphone signals generated by the microphones F and B. Such audio conditions are e.g. "conversation background quiet", "conversation background interference noise", "television" etc. Depending on the audio conditions that are detected, the parameters relating to the signal processing in the signal processing unit are automatically adjusted in order to adapt the signal processing to the audio conditions that have been detected.

Figure 2:
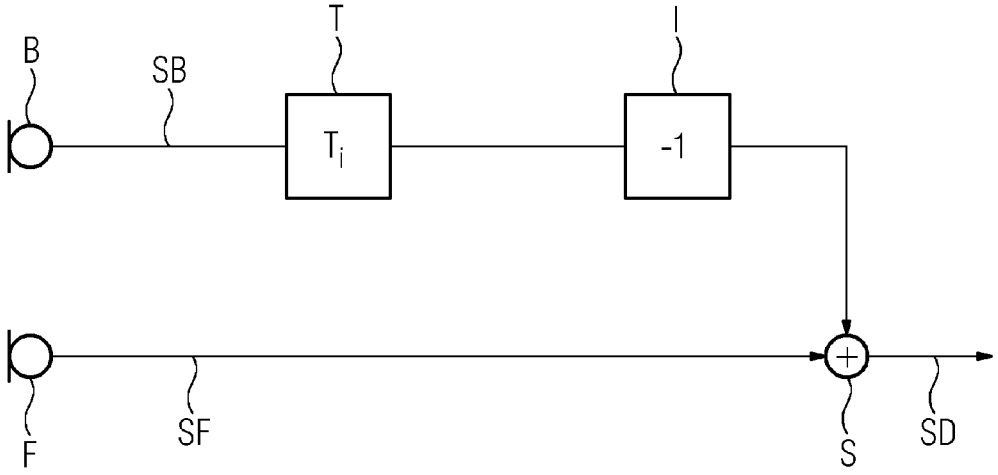
FIG 2 PRIOR ART
FIG. 2 shows the electrical interconnexion of two microphones in a directional microphone system as per the prior art.

FIG. 2 shows the usual structure of a directional microphone system that is used in hearing aid devices, comprising two microphones F (front) and B (back). The microphones F and B are usually separated by a distance of between 5 mm and 15 mm and are equally sensitive in all spatial directions (omnidirectional). In order to achieve directional sensitivity, the microphones F and B are electrically connected together and the microphone signals generated by them are therefore associated. In this case, the microphone signal SB that is generated by the back microphone B is usually delayed by an internal time delay $T_i$ in a delay element T, and subtracted from the microphone signal SF that is generated by the front microphone F. The subtraction is generally performed by an inverter I in conjunction with a summation element S. As a result of this, the microphone signal SB originating from the back microphone B is inverted and added to the microphone signal SF originating from the front microphone F. The directional microphone signal SD is therefore produced at the output of the summation element S.

If the internal time delay $T_i$ is adjusted such that it corresponds to the propagation time of an acoustic signal between the two microphones F and B (base time delay), the acoustic signal of a signal source that is located on the connection line of the two microphones is least attenuated when the signal source is situated in front of the front microphone F, and most attenuated when the signal source is situated behind the back microphone B. By means of varying the internal time delay $T_i$, the direction of maximal attenuation can be swiveled within the environment in a known manner. It is thereby possible to set directional characteristics such as a "cardioid radiation pattern", "super-cardioid radiation pattern", "hyper-cardioid radiation pattern", "figure-of-eight radiation pattern", etc.

The invention is not restricted to the customary embodiment of a directional microphone system for a hearing aid device as illustrated. On the contrary, it can also be applied in a similar manner to other interconnexions of the microphones and directional microphone systems featuring more than two microphones.

Figure 3:
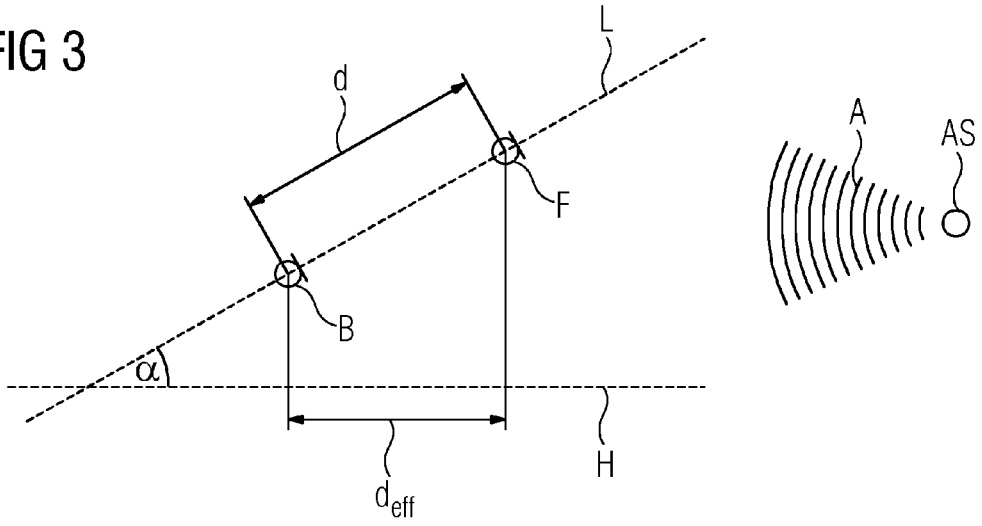
FIG. 3 shows the position of two microphones in relation to an acoustic source.

FIG. 3 serves to clarify the effects of a position that is changed relative to an ideal position of a hearing aid device or its directional microphone system that is worn on the head of a user. It is assumed initially that an acoustic source is located in front of the front microphone F on a straight line through the two microphones F and B. The sound therefore arrives at the front microphone F and, delayed by the propagation time that the sound requires for the distance d between the two microphones F and B, at the back microphone B. The internal delay $T_i$ (cf. FIG. 2) is then adjusted such that it corresponds to the propagation time required by the sound to cover the distance d.

If, as illustrated in FIG. 3, an acoustic source AS is now situated away from the straight line L as a result of a non-ideal wearing position of the relevant hearing aid device, the acoustic signal A that is emitted from the acoustic signal source AS arrives correspondingly earlier at the back microphone B, since the acoustic signal only needs to cover the effective distance $d_{eff}$ for this purpose. The effective distance $d_{eff}$ is derived from the separation of the projection of the front microphone F and of the back microphone B onto a horizontal plane H. If an internal time delay is not adapted accordingly, the desired directional characteristics are not set.

According to the invention, a time delay resulting from the effective distance $d_{eff}$ is determined and set automatically.

In many hearing aid devices, the default setting already assumes that the microphones of the directional microphone system do not lie on a horizontal plane, but that a straight line through the microphones implies a predefined angle $\alpha$ relative to the horizontal even in the ideal wearing position. However, this does not change anything in relation to the inventive approach, since the ideal wearing position can also deviate from the actual individual wearing position in this context, and the invention makes provision for capturing such a deviation and for correcting its effects accordingly.

Figure 4:
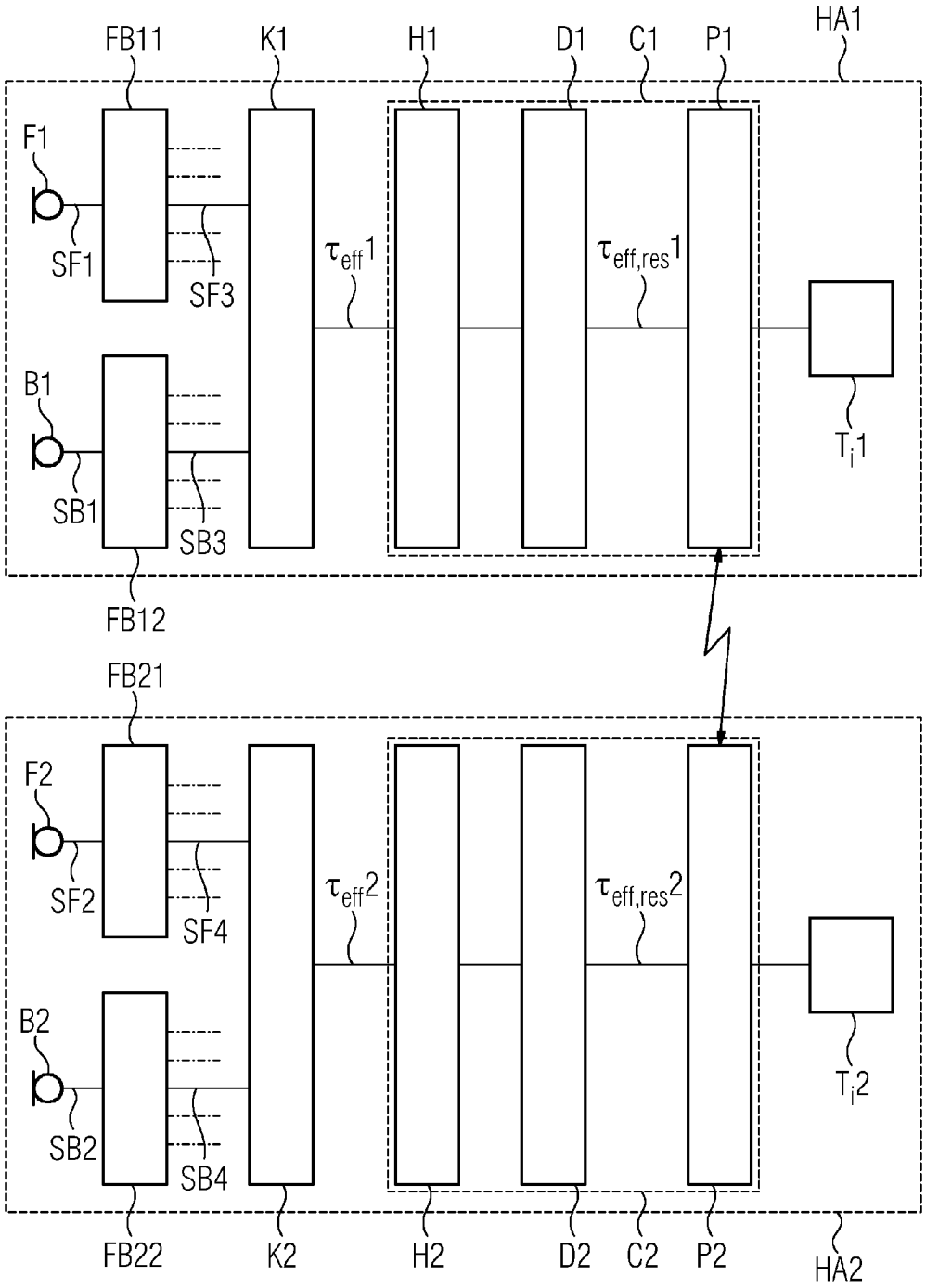
FIG. 4 shows a hearing aid device system comprising two hearing aid devices, in which it is possible to determine an optimized signal delay between two microphones in each case, these being connected to a directional microphone system.

With reference to a hearing aid device system comprising two hearing aid devices HA1 and HA2, FIG. 4 shows the components that are required for determining an optimized internal time delay for the directional microphone system concerned. In this case, the first hearing aid device HA1 features a front microphone F1 and a back microphone B1, and the second hearing aid device HA2 features a front microphone F2 and a back microphone B2. The microphone signals SF1, SB1, SF2, SB2 emitted from the microphones are first supplied to the filter banks FB11, FB12 and FB21, FB22 respectively, in which the microphone signals SF1, SB1, SF2, SB2 are subdivided into a plurality of frequency bands in each case. The further signal processing then takes place in parallel in the respective frequency bands. The calculation of the internal time delay is described for a specific frequency band below. The calculation is performed analogously for the other frequency bands.

In the case of the hearing aid device HA1, the microphone signals SF3, SF4 of the relevant frequency band are first supplied to a cross-correlation analysis unit K1. The cross-correlation function of the microphone signals, which is dependent on a time delay $\tau$, has a maximum which corresponds to the propagation time of the acoustic signal between the two microphones in the case of a time delay $\tau_{eff}$1. The invention advantageously provides for determining within a specific time period, e.g. within a minute, a plurality of cross-correlation functions of the microphone signals SF3 and SF4 depending on the time delay $\tau$. The statistical analysis of the determined cross-correlation functions is then performed in a histogram analysis unit H1, which is part of a control unit C1. In this case, for the observed time period, the relative frequency of the determined effective time delays $\tau_{eff}$1 is plotted depending on the time delay $\tau$, for which the respective cross-correlation function had its maximum. A resulting effective time delay $\tau_{eff,\ res}$1, for which the cross-correlation functions most frequently have their maximum, is then determined therefrom in a time delay determining unit D1. This time delay is then applied as a possible internal time delay. However, before the internal time delay is actually set, a validation check of the resulting effective time delay $\tau_{eff,\ res}$1 is preferably performed first in a validation check unit P1. Provision is preferably made in the validation check unit P1 for comparing the determined resulting effective time delay $\tau_{eff,\ res}$1 with a predefined reference value range and with the resulting effective time delay $\tau_{eff,\ res}$2 that was determined analogously in the second hearing aid device HA2. Significant variations in the resulting effective time delays $\tau_{eff,\ res}$1 and $\tau_{eff,\ res}$2 determined in both hearing aid devices HA1 and HA2 suggest unusable results.

In the event of a successful validation check, the internal delay $T_i$1 in the hearing aid device HA1 and likewise the internal delay $T_i$2 in the hearing aid device HA2 are adjusted depending on the respectively determined resulting effective time delay $\tau_{eff,\ res}$1 or $\tau_{eff,\ res}$2. In particular, the internal time delay $T_i$1 or $T_i$2 is set equal to the inventive specific resulting effective time delay $\tau_{eff,\ res}$1 or $\tau_{eff,\ res}$2 respectively.

The internal time delay $T_i$2 for the second hearing aid device HA2 of a relevant hearing aid device system is determined analogously by means of a control unit C2 which comprises a cross-correlation analysis unit K2, a histogram analysis unit H2, a time delay determining unit D2 and a validation check unit P2.

In the same way as the association shown in FIG. 2, for example, provision is made in the hearing aid devices HA1 and HA2 for an association of the microphone signals, whereby the determined internal time delays $T_i$1 and $T_i$2 are set in respective delay units.

The invention claimed is:

1. A hearing aid device with a directional microphone system, comprising:

a first microphone configured to output a first microphone signal and a second microphone configured to output a second microphone signal;

a delay unit configured for generating a directivity by delaying the second microphone signal or a fourth microphone signal derived therefrom by an internal time delay and associating with the first microphone signal or with a third microphone signal derived therefrom for the purpose of generating a directional microphone signal;

a cross-correlation analysis unit connected to receive the first or the third microphone signals and to receive the second or the fourth microphone signals, and configured for determining a value of a cross correlation of the two microphone signals depending on a time delay, and to determine an effective time delay for which the cross-correlation function has a maximum;

a classifier for determining an audio condition in which the hearing aid device is currently situated; and a control unit for adjusting the time delay in dependence on the value of the cross correlation of the two microphone signals, wherein the time delay is adjusted depending on the audio condition.

2. The hearing aid device according to claim 1, wherein said control unit is configured to adjust the internal time delay in "conversation background quiet" audio conditions.

3. The hearing aid device according to claim 1, which further comprises a histogram analysis unit for performing a histogram analysis on the basis of a number of effective time delays that are determined within a specific time period, and wherein a resulting effective time delay is determined by way of the histogram analysis.

4. The hearing aid device according to claim 1, wherein the effective time delay or the resulting effective time delay can be set as an internal time delay.

5. The hearing aid device according to claim 1, which comprises a validation check unit for performing a validation check of the determined effective time delay or the determined resulting effective time delay, and wherein the determined value of the effective time delay or the determined value of the resulting effective time delay can be set depending on the result of the validation check.

6. The hearing aid device according to claim 1, which comprises a filter bank for dividing the microphone signals into different frequency bands, and wherein the adjustment of the internal time delay depends on the relevant frequency band.

7. A hearing aid device system, comprising:

a first hearing aid device according to claim 1 to be worn on or in the left ear of a user;

a second hearing aid device according to claim 1 to be worn on or in the right ear of a user; and wherein a validation check is performed on the basis of a comparison of the effective time delays or resulting effective time delays that are determined in the first and second hearing aid devices.

8. A method of operating a hearing aid device provided with a directional microphone system having a first microphone, from which a first microphone signal is output, and a second microphone, from which a second microphone signal is output, the method which comprises:

generating a directivity by delaying the second microphone signal or a fourth microphone signal derived therefrom in a delay unit by an internal time delay and associating with the first microphone signal or a third microphone signal derived therefrom;

determining a value of a cross-correlation of the two microphone signals with a cross-correlation function depending on a time delay, and determining an effective time delay for which the cross-relation function has a maximum;

determining audio conditions in which the hearing aid device is currently situated; and adjusting the internal time delay depending on the value of the cross-correlation of the two microphone signals and depending on the current audio conditions.

9. The method according to claim 8, which comprises adjusting the internal time delay in "conversation background quiet" audio conditions.

10. The method according to claim 8, which comprises determining a resulting effective time delay by way of a histogram analysis on the basis of a number of effective time delays that are determined within a specific time period.

11. The method according to claim 8, which comprises subjecting the value of the effective time delay thus determined or the value of the resulting effective time delay thus determined to a validation check.

12. The method according to claim 8, which comprises setting the effective time delay thus determined or the resulting effective time delay thus determined as an internal time delay.

13. The method according to claim 8, which comprises setting the internal time delay in dependence on a frequency of an acoustic input signal arriving in the hearing aid device.

14. A method of operating a hearing aid device system, comprising:

providing a first hearing aid device to be worn on or in the left ear of a user and to be operated according to the method of claim 13;

providing a second hearing aid device to be worn on or in the right ear of user and to be operated according to the method of claim 13;

performing a validation check on a basis of a comparison of the effective time delays or resulting effective time delay determined in the respective first and second hearing aid devices.

15. A method of operating a hearing aid device system, comprising:

providing a first hearing aid device to be worn on or in the left ear of a user and to be operated according to the method of claim 11;

providing a second hearing aid device to be worn on or in the right ear of user and to be operated according to the method of claim 11;

performing a validation check on a basis of a comparison of the effective time delays or resulting effective time delay determined in the respective first and second hearing aid devices.

16. A method of operating a hearing aid device system, comprising:

providing a first hearing aid device to be worn on or in the left ear of a user and to be operated according to the method of claim 12;

providing a second hearing aid device to be worn on or in the right ear of user and to be operated according to the method of claim 12;

performing a validation check on a basis of a comparison of the effective time delays or resulting effective time delay determined in the respective first and second hearing aid devices.

* * * * *